United States Patent [19]

Coccia

[11] 4,256,290

[45] Mar. 17, 1981

[54] BOTTOM COOLING ARRANGEMENT FOR REDUCTION APPARATUS

[75] Inventor: Larry A. Coccia, Elizabeth, Pa.

[73] Assignee: Pullman Incorporated, Chicago, Ill.

[21] Appl. No.: 85,162

[22] Filed: Oct. 15, 1979

[51] Int. Cl.[3] ..... F27B 1/20

[52] U.S. Cl. ..... 266/191; 266/195

[58] Field of Search ..... 266/191, 195

[56] References Cited

U.S. PATENT DOCUMENTS 3,467,368 9/1969 Celada et al. ..... 266/195 X 3,836,131 9/1974 Beggs ..... 266/195 X

*Primary Examiner*—M. J. Andrews

*Attorney, Agent, or Firm*—Richard J. Myers

[57] ABSTRACT

An apparatus for reduction of iron ore to sponge iron includes a reduction vessel having upper gas inlet ports, a charging opening, a lower discharge chamber including gas discharge openings and a bottom discharge door. The discharge door includes an internal dome-shaped hollow body provided with discharge openings which are connected to a source of cooling gas for cooling the discharge chamber.

12 Claims, 7 Drawing Figures

BOTTOM COOLING ARRANGEMENT FOR REDUCTION APPARATUS

BACKGROUND OF THE INVENTION

1. Field of the Invention

The present invention broadly relates to the subject of iron ore treating apparatus. More specifically, it relates to an improved bottom cooling arrangement utilized in the reduction of iron ore to sponge iron.

2. Description of the Prior Art

Celada U.S. Pat. Nos. 2,900,247 and 3,467,368 disclose a process and apparatus describing the reduction of iron ore to sponge iron by passing a reducing gas mixture at high temperature through a fixed bed of ore in lump form. The present invention is an improvement over the structure shown in the apparatus patent to Celada U.S. Pat. No. 3,467,368. In the present invention the reduction vessel also includes a cooling arrangement which cooperates with the lower discharge chamber and discharge opening of a reduction vessel. Other patents pertinent to the present invention are U.S. Pat. Nos. 3,216,820 patented Nov. 9, 1966; 3,379,623, Apr. 23, 1968; 3,591,158, July 6, 1971; 3,836,131, Sept. 17, 1974; 4,054,444, Oct. 18, 1977 and Netherlands Pat. 24,624 published Feb. 16, 1931.

The aforementioned patents disclose various reduction vessels having different types of configuration and cooling means. Certain of these patents include bottom closure members having various types of configurations such as dome-shaped and frusto-conical shaped devices. None of these however, disclose the specific arrangement of the present door arrangement which includes orifices or outlets connected to a suitable source of cooling gas which provide for cooling of the lower chamber of the vessel in combination with the cooling gases supplied to the reduction apparatus in conventional manner.

SUMMARY OF THE INVENTION

In the present invention a reduction apparatus includes at its upper end a hemisphere structure having a central material charging inlet and a pair of gas inlets providing for the entrance of reduction gases to the reduction chamber of the vessel. The vessel is similar to that disclosed in the above mentioned Celada patent which is provided at its intermediate end with a frusto-conical cooled structure and at its lower end with a discharge chamber. In the present invention the discharge chamber includes gas outlets and at its lower end a material outlet through which the reduced sponge iron is removed. The discharge outlet also is provided with a door which may be hingedly moved between open and closed positions and which includes an inner body structure of dome-shaped configuration having a plurality of outlets and the interior of said dome being of hollow construction. The hollow dome of the door includes a connector element which in the closed position is in communication with a gas inlet conduit extending into the lower end of the discharge chamber and being removably connected to the dome structure for supplying gas through the discharge outlets into the interior of the lower discharge chamber.

DESCRIPTION OF THE PREFERRED EMBODIMENT

Figure 1:
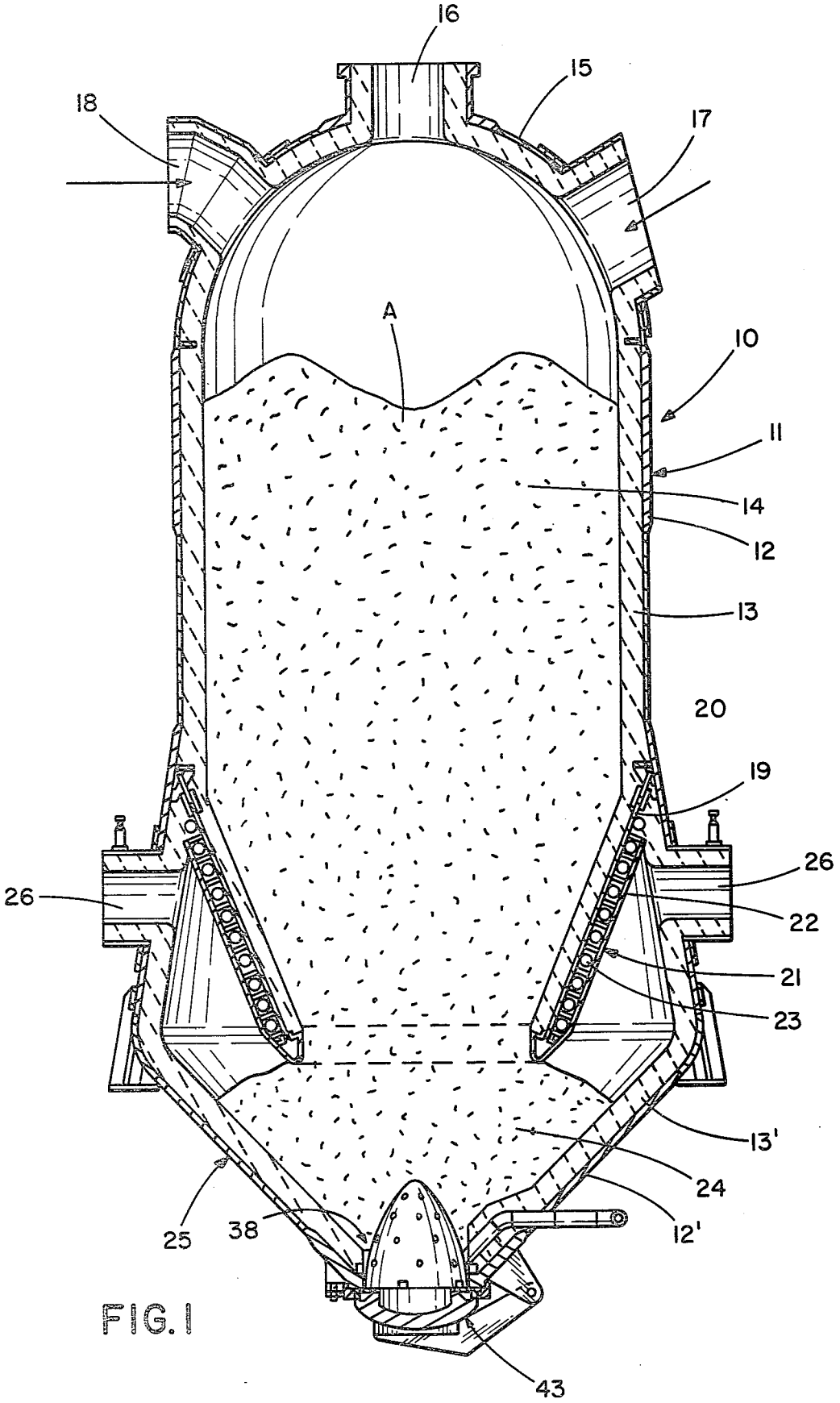
FIG. 1 is a cross-sectional view through an improved reduction apparatus for producing sponge iron.

Referring to FIG. 1 a reduction apparatus generally designated by the reference character 10 includes an upright cylindrical body or vessel 11 having a metal outer shell 12 having suitably connected thereto a ceramic lining 13 in conventional fashion. The outer shell 12 continues downwardly and at its lower end is provided with a continuation 12' to which also a ceramic lining 13' is suitably connected. A reaction chamber 14 is provided within the body to reduce an iron ore charge generally designated at A to sponge iron. The upper end of the cylindrical body 11 is provided with a hemispherical upper portion 15 having a centrally disposed charging opening 16 adapted to be closed by a suitable cap or door (not shown). A hot reducing gas opening 17 is provided on one side of the vessel 11 and on its other side is provided with a cooling reducing gas inlet opening 18.

Figure 2:
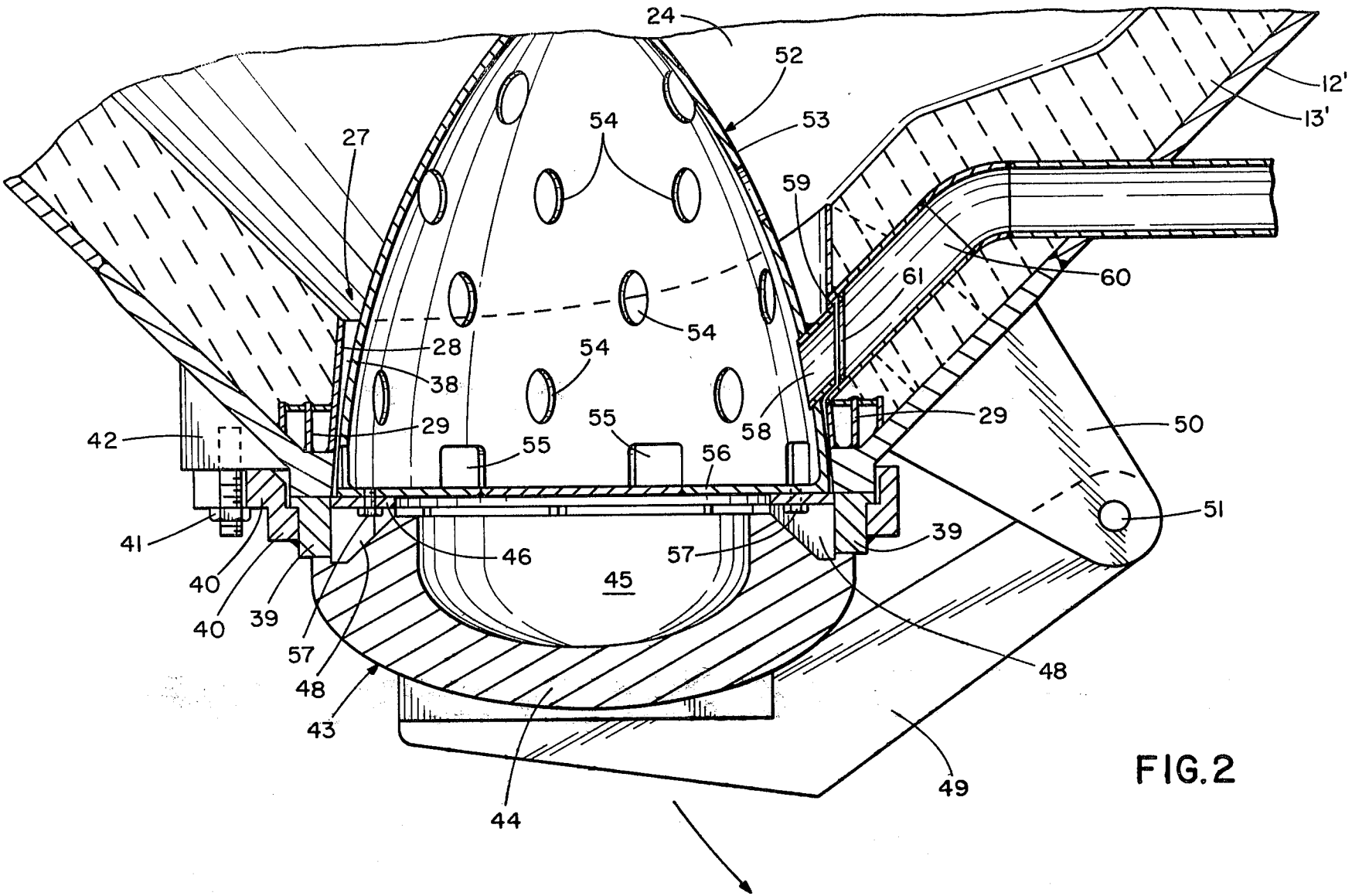
FIG. 2 is an enlarged cross-sectional view of a discharge outlet and bottom cooling arrangement for the reduction vessel shown in FIG. 1.
Figure 3:
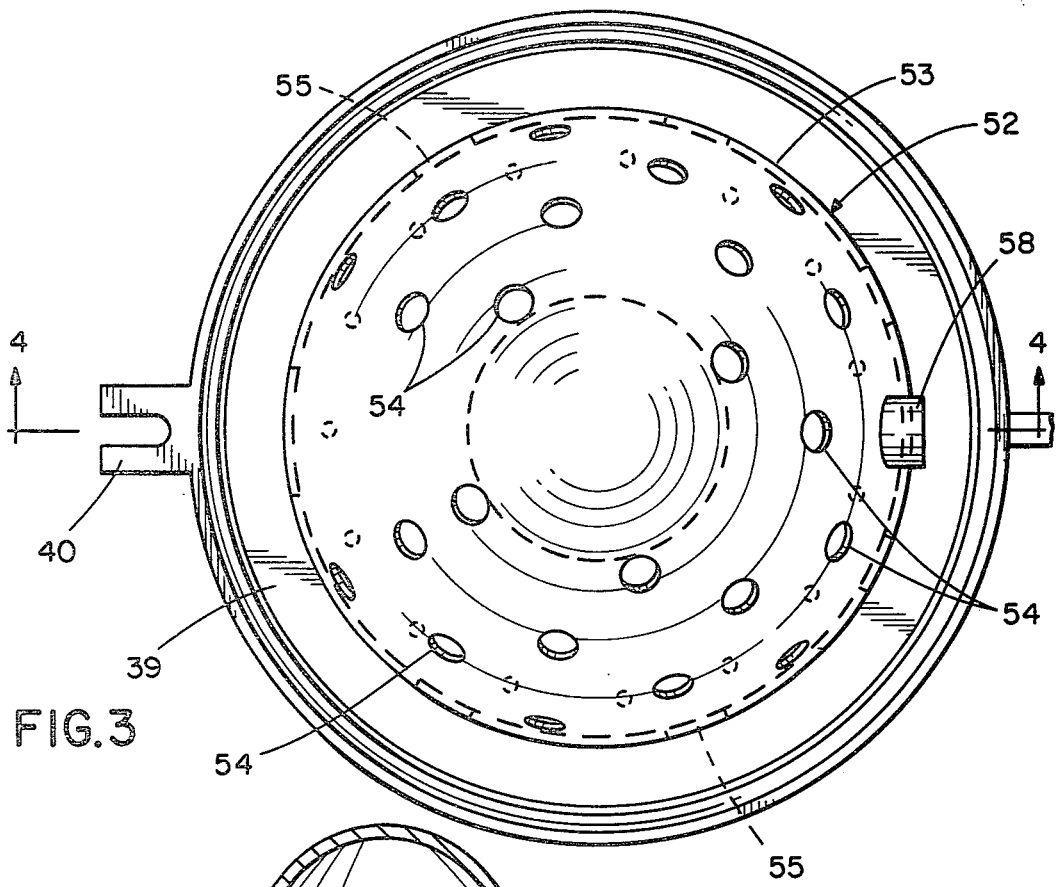
FIG. 3 is a plan view of a dome-shaped body portion of a discharge door.
Figure 4:
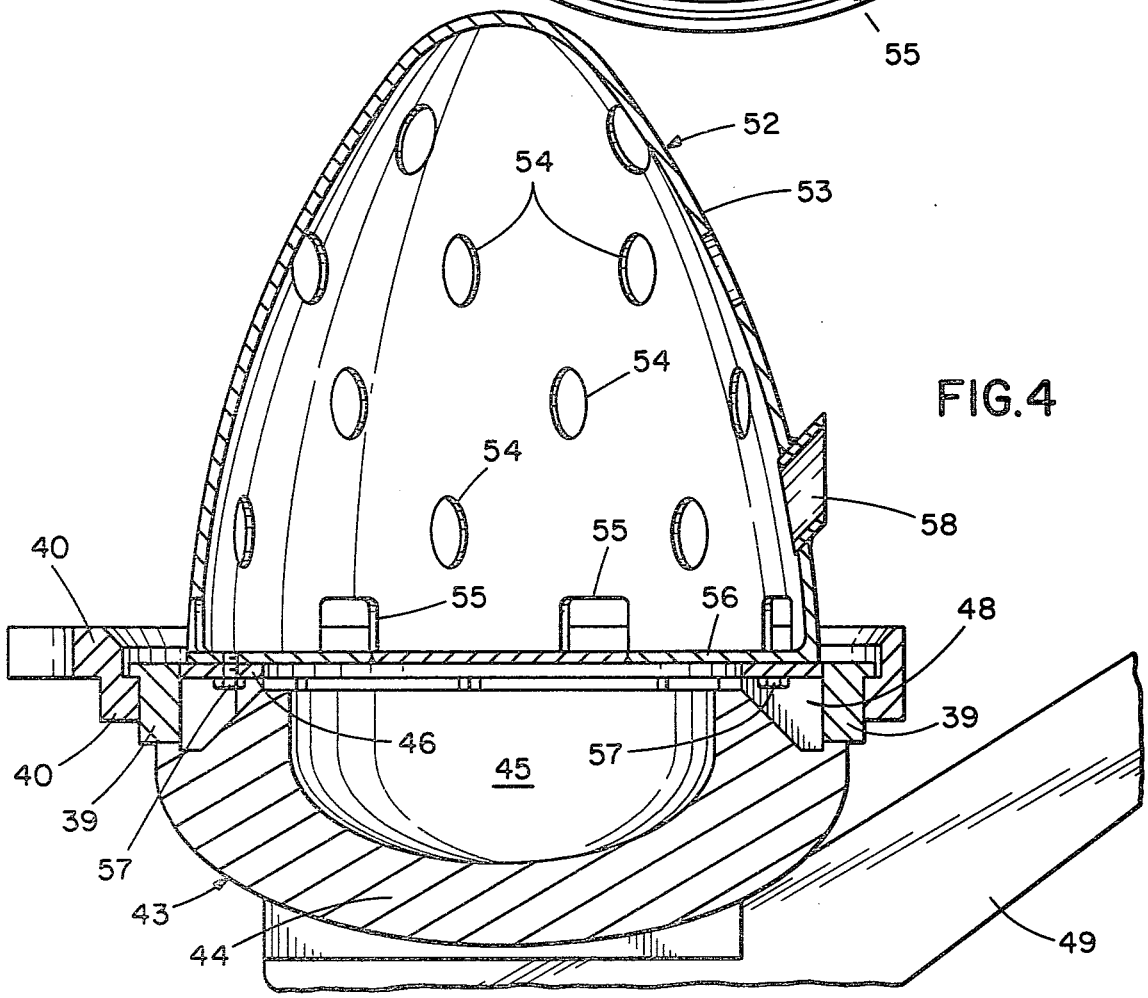
FIG. 4 is a cross-sectional view taken along the line 4—4 of FIG. 3.
Figure 5:
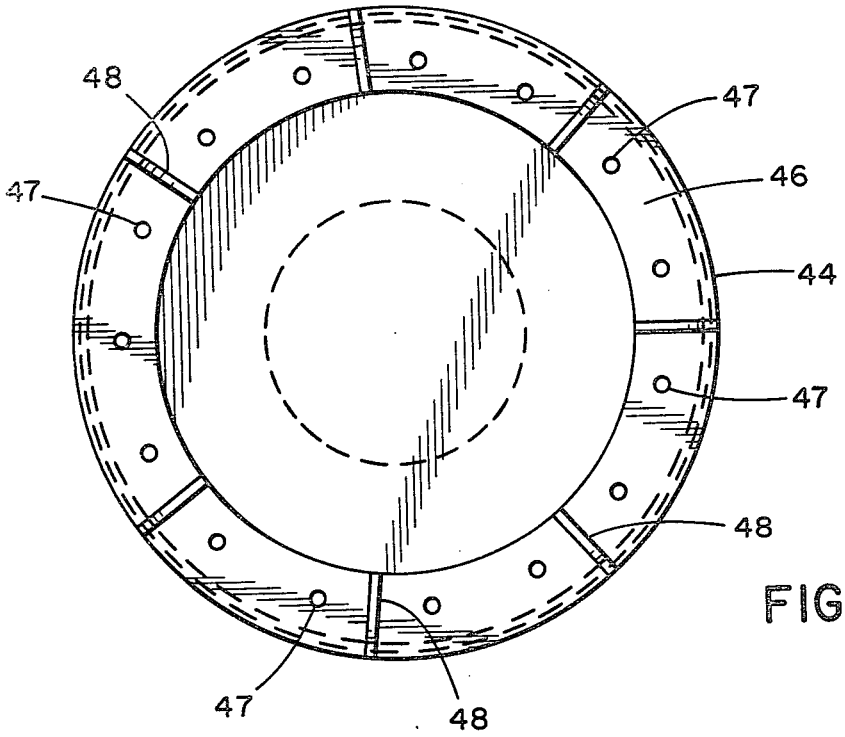
FIG. 5 is a plan view of a portion of a discharge door.

A lower portion of the reaction chamber 14 is provided with a frusto-conical baffle 19 having connected thereto a ceramic lining 20 and includes a cooling coil structure 21 comprising a frusto-conical outer plate 22 which supports a plurality of cooling pipes 23 to which cooling water is directed as best shown in the aforementioned Celada, et al U.S. Pat. No. 3,467,368. The lower outer shell structure 12' and ceramic lining 13' define a discharge chamber generally designated at 24. The discharge chamber 24 is provided in a lower vessel portion designated generally at 25 and includes a plurality of laterally extending gas outlets 26. The lower vessel portion 25 also includes a central discharge outlet 27 for discharging from the vessel metal iron products known as sponge iron. An outlet ring 28 best shown in FIG. 2 is anchored by means of a cylindrical welded metal anchoring structure 29 in the lower portion of the ceramic lining 13'. As best shown in FIG. 2 a discharge door 43 comprises a lower external body portion 44 having a cavity 45. The portion 44 has connected thereto a connector ring 46 which includes a plurality of openings 47 as best shown in FIG. 5. The connector ring includes downwardly extending brackets or gussets 48 which are suitably connected to the lower body portion 44. A ring 39 is suitably connected to the door body portion 44 and provides for clamping of the door 43 in the closed position shown in FIG. 2 against the lower end of the discharge outlet 38. Clamping of the door 43 in its closed position is achieved by a clevis type bracket 40, which is shown in FIG. 2 and which is secured to the bracket structure 42 provided on the lower casing structure 12' by means of bolt and nut assembly 41.

The door 43 upon release of the bolt and nut assembly 41 can then swing downwardly on hinge arm 49 hingedly connected to a hinge bracket 50 and pivoted thereto as indicated by pivot pin 51. The bracket 50 is suitably connected to a portion of the lower casing wall 12'.

As best shown in FIG. 2 the door 43 is also provided with an internal door body member generally indicated at 52 and more specifically comprising a metal dome 53. The dome 53 is of a hollow construction and is provided with a plurality of upper discharge openings 54. The dome also includes a plurality of circumferentially disposed lower openings 55. A lower plate 56 which may be integrally formed with the dome 53 is connected to the ring 46 by means of cap screws 57. As best shown in FIG. 2 a tubular connector stub 58 projects outwardly from the dome 53 and provides communication with a cooling pipe 60 embedded with the ceramic extension 13' with the said pipe 60 projecting outwardly from the vessel and being suitably connected to a source of cooling gas. An opening 59 is provided in the sleeve or outlet ring 38 and thus as best shown in FIG. 2 a cooling gas connection is made with respect to the stub 58 and the pipe 60. A deflector 61 is positioned within the end of the cooling pipe 60.

Figure 6:
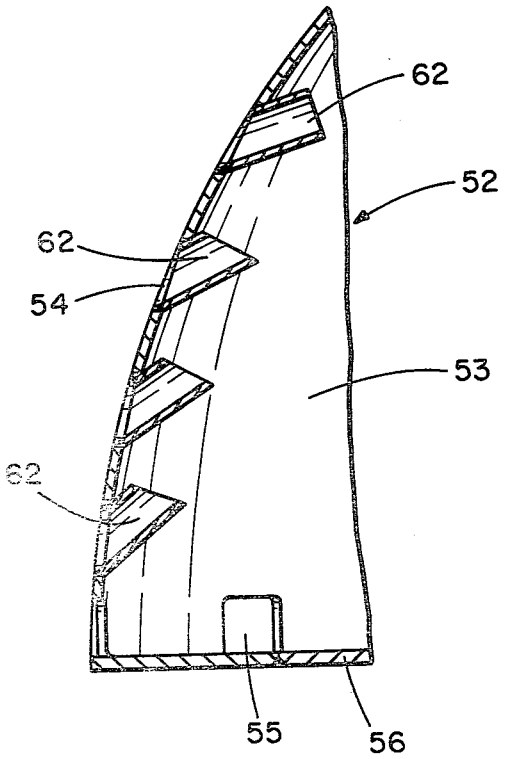
FIG. 6 is a partial cross-sectional view of a modified portion of a cooling dome or manifold.
Figure 7:
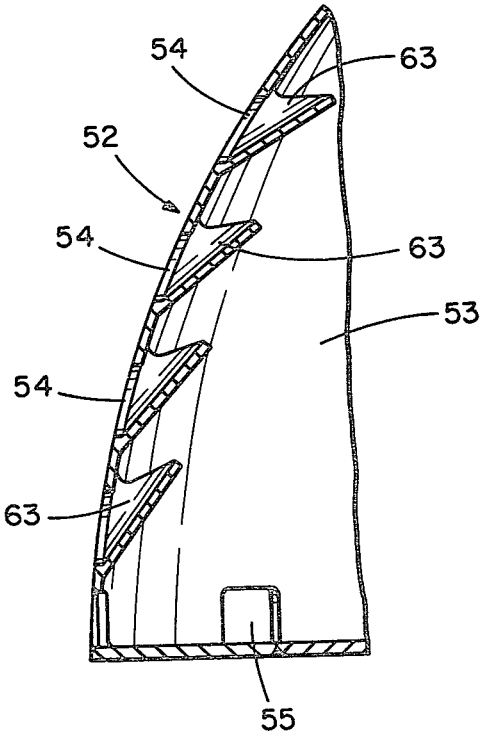
FIG. 7 is another modification of a dome or cooling manifold.

In the modifications shown in FIGS. 6 and 7 the dome 53 is provided with tubular stubs 62 which are suitably welded to the internal surface of the dome and extend or project upwardly with respect to each of the openings 54. In FIG. 7 the dome also includes deflectors or integral baffles 63 which are integrally formed with the dome 53 such as would be the case if the dome were made of cast material. In both instances the baffles 63 and the tubular stubs act as deflectors to prevent reducing material, which is loaded within the discharge chamber, from clogging up the gas outlets 62 and 63 thus precluding the necessity of frequent cleanout of the interior of the dome which of course can be achieved by disassembling the door structure.

The aforementioned Celada U.S. Pat. No. 2,900,247 discloses the operation of the type of reduction vessel with which the present invention is concerned. The process is well known in the art and reduces iron ore to sponge iron by passing a reducing gas mixture at high temperature through a fixed bed of the ore in lump form. In addition to the normal cooling of the internal charge within the furnace which is occasioned by the reducing gases entering into the process from the top of the furnace there also is recycled gas which is injected into the bottom dome or closure member of the present invention. Thus the bottom door not only serves its normal function but also provides an effective lower cooling means for the discharge chamber of the reaction vessel.

What is claimed is:

1. In an apparatus for the gaseous reduction of metal oxide ore including a reactor vessel having an elongated vertically disposed reaction chamber and a lower discharge chamber, gas inlet means and ore charging means adjacent the upper end of said reaction chamber, gas outlet means communicating with said discharge chamber, and a discharge outlet for discharging reduced material from said discharge chamber including an opening in the vessel, the improvement comprising;

a discharge door, means movably supporting said door for movement between closed and open positions relative to said opening, said door including an external body portion supported over said opening, an internal body portion supported on said external body portion and in closed position of said door being disposed within said outlet, and cooling means on said internal body portion for directing a cooling fluid to said discharge chamber.

2. The invention in accordance with claim 1, including a cooling conduit on said vessel communicating with said internal body portion.

3. The invention in accordance with claim 2, said internal body portion having a plurality of discharge openings directing cooling fluid into said discharge chamber.

4. The invention in accordance with claim 1, said internal body having a hollow configuration including a plurality cooling fluid discharge openings, and means for supplying coolant fluid through said discharge openings to said discharge chamber.

5. The invention in accordance with claim 4, said coolant supply means including a conduit on said vessel, a connector conduit on said internal body, said connector conduit and conduit being interconnected during the closed position of said door and being disconnected during the open position.

6. The invention in accordance with claim 1, said internal body being of hollow dome-shaped configuration and including a plurality of discharge openings, conduit coupling means on said internal body, a coolant fluid source on said vessel, said coupling means and fluid source being interconnected during said closed position of said door, and being disconnected during the open position of said door.

7. The invention in accordance with claim 6, said coupling means including a pipe stub supported on said internal body portion, and said coolant fluid source comprising a pipe supported on said vessel adjacent a lower portion thereof.

8. The invention in accordance with claim 7, said discharge outlet including a cylindrical sleeve supported in said discharge chamber defining said discharge opening, said sleeve having an opening and said pipe and coupling means communicating through said openings.

9. The invention in accordance with claim 1, said internal body being of a hollow dome-shaped configuration including a plurality of discharge openings, means for providing cooling fluid to said dome-shaped body to discharge the same through said discharge openings to said discharge chamber, and baffle means on said dome-shaped body adjacent said discharge openings for deflecting reduced material from entrance into said body.

10. The invention in accordance with claim 9, said baffle means including a plurality of open end tube stubs connected over said discharge openings and extending in a generally upward direction.

11. The invention in accordance with claim 10, said tube stubs projecting within said dome-shaped body.

12. The invention in accordance with claim 9, said dome-shaped body and baffle means being integrally formed.

* * * * *